US006467308B2

(12) United States Patent
Butler

(10) Patent No.: US 6,467,308 B2
(45) Date of Patent: Oct. 22, 2002

(54) JEWELRY PRONG SETTING

(75) Inventor: Jerome D. Butler, Great Neck, NY (US)

(73) Assignee: Alfred Butler, Inc., New York, NY (US)

( * ) Notice: Subject to any disclaimer, the term of this patent is extended or adjusted under 35 U.S.C. 154(b) by 0 days.

(21) Appl. No.: 09/810,274

(22) Filed: Mar. 16, 2001

(65) Prior Publication Data

US 2002/0000097 A1 Jan. 3, 2002

Related U.S. Application Data

(63) Continuation-in-part of application No. 09/747,249, filed on Dec. 21, 2000.
(60) Provisional application No. 60/208,333, filed on May 31, 2000.

(51) Int. Cl.[7] ..... A44C 17/02
(52) U.S. Cl. ..... 63/26; 63/27
(58) Field of Search ..... 63/26, 27

(56) References Cited

U.S. PATENT DOCUMENTS

D35,741 S * 2/1902 Wittstein ..... D11/92
1,293,028 A * 2/1919 Cambell ..... 63/26
1,313,052 A * 8/1919 Bauman ..... 63/26
2,200,841 A * 5/1940 Gaertner ..... 63/27
2,811,024 A * 10/1957 Thompson ..... 63/26
4,972,685 A * 11/1990 Poll ..... 63/26
6,105,393 A * 8/2000 Takessian ..... 63/26

* cited by examiner

*Primary Examiner*—J. J. Swann
*Assistant Examiner*—Andrea Chop
(74) *Attorney, Agent, or Firm*—Gottlieb, Rackman & Reisman, P.C.

(57) ABSTRACT

A prong setting for a ring or other jewelry item is provided. The prong setting is mounted along the jewelry item and includes one or more first prong elements and one or more facing second prong elements for defining an opening therebetween in which a jewelry stone is received. Preferably, each prong element includes a wire or lip portion for selectively engaging the jewelry stone. The wire portion is specially sized and shaped to enhance the strength of the setting in holding the stone therewith. In one embodiment, the prong elements are movable with respect to one another in order to be able to selectively adjust the distance between the prong elements, and thus the size of the opening. As a result, the prong setting can accommodate jewelry stones of varying size.

19 Claims, 6 Drawing Sheets

FIG. 3
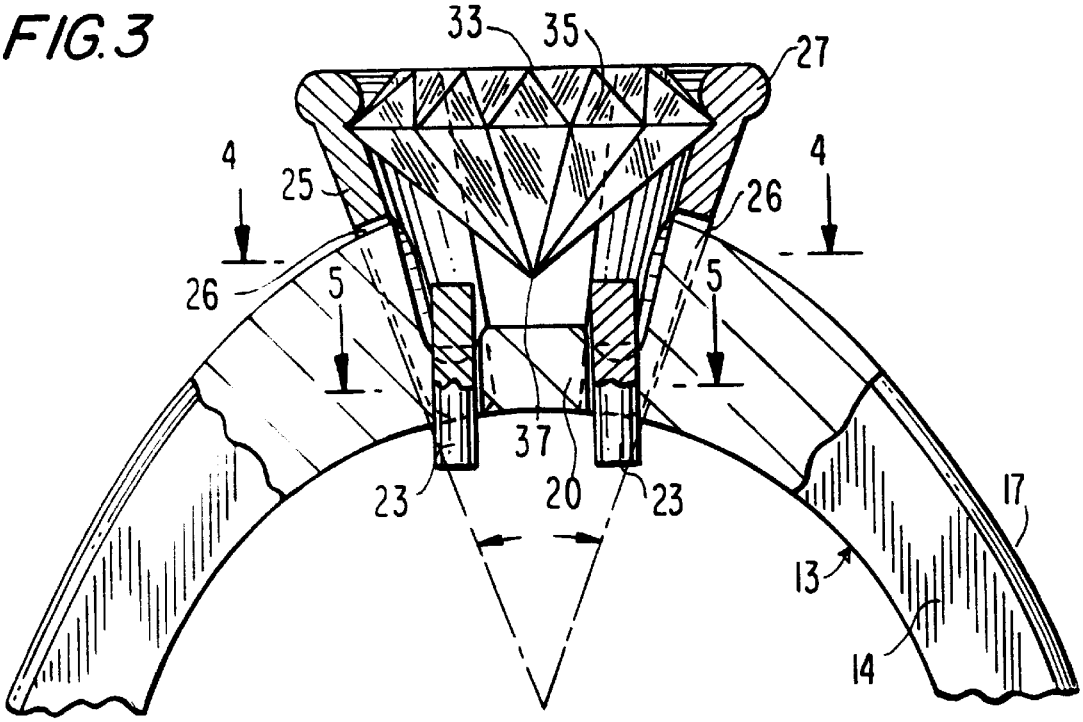
FIG. 4
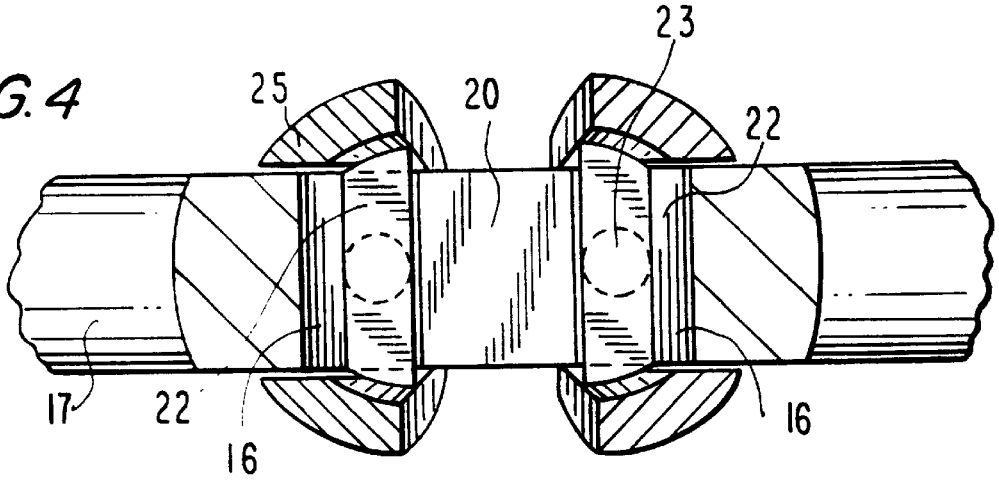
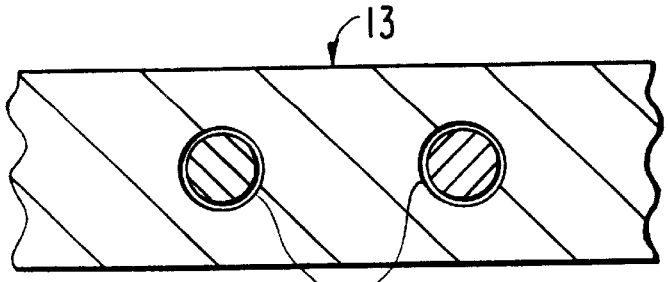
FIG. 5

FIG. 8
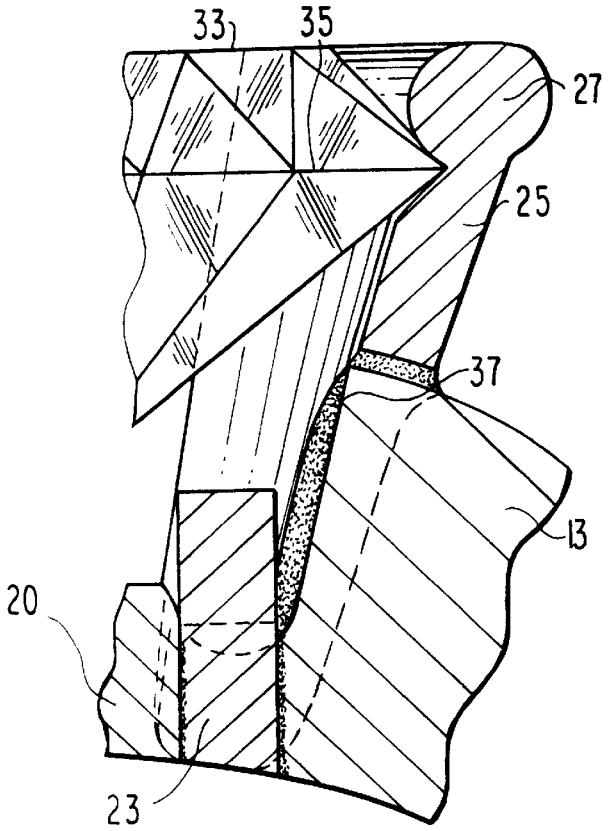
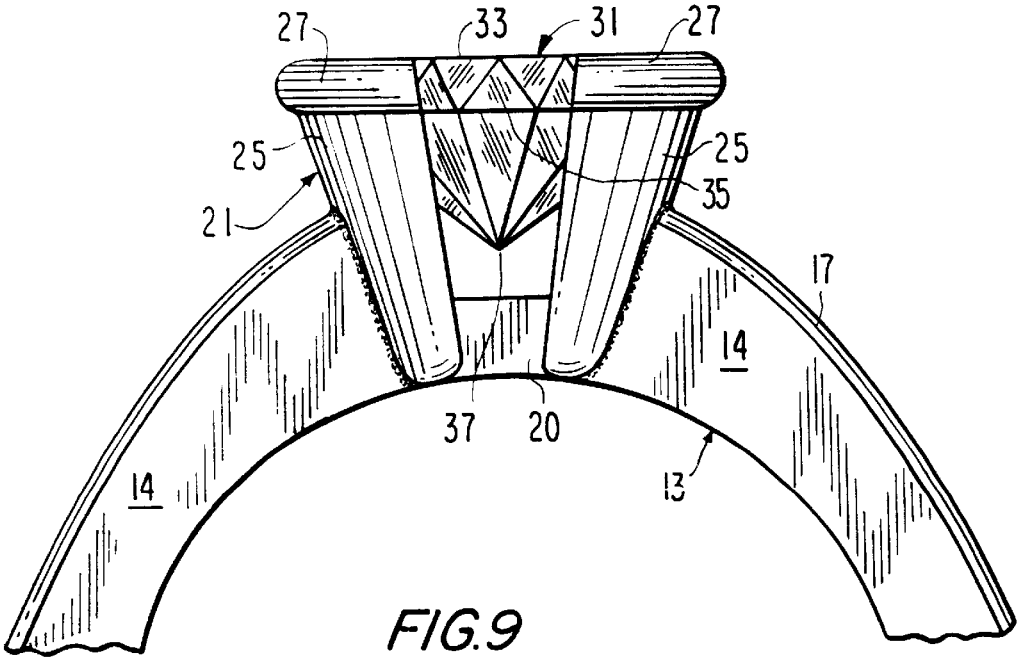
FIG. 9

JEWELRY PRONG SETTING

This application is a continuation-in-part of application Ser. No. 09/747,249 filed Dec. 21, 2000, currently pending, which in turn claims benefit of provisional patent application Serial No. 60/208,333 filed May 31, 2000.

BACKGROUND OF THE INVENTION

This invention relates to a setting for a jewelry item, and more particularly, to a prong setting for accommodating different size jewelry stones.

In the jewelry trade, prong settings are used to hold and retain diamonds and other types of precious or semi-precious stones. Presently, prong settings are fixed in position with respect to the jewerly item, and therefore different bezel sizes (openings) are required for different size stones. Prong settings usually come in ¼ carat (4 m/m), ⅜ carat (4½ m/m), one-half carat–⅝ carat–¾ carat–1 carat—all the way up to about 2 carats. For each size, there is a ½ m/m increase. Moreover, even with the ½ m/m separation, the stone that is used often does not fit appropriately.

The problem with the prior art prong settings is that it is necessary to have a different size setting for each ring or other jewelry item in order to cover the various range of stone sizes. Moreover, even having different size settings is less than desirable, since some stones may not fit appropriately within the prong setting. Moreover, prior art prong settings are less than adequate in terms of strength in holding a stone in position therewithin. Even though a conventional bezel setting overcomes this disadvantage and has added strength for holding the stone in position within the setting, such a setting is less than desirable from an aesthetic point of view. In a conventional bezel setting, a substantial portion of the retained stone is partially or completely hidden from view.

Accordingly, it is desirable to provide a prong type setting for a ring or other jewelry item which overcomes the above disadvantages and enables the easy retention of various size jewelry stones.

SUMMARY OF THE INVENTION

Generally speaking, in accordance with the invention, a prong setting for a ring or other jewelry item is provided. The prong setting is mounted along the jewelry item and includes a first prong element and a facing second prong element for defining an opening therebetween in which a jewelry stone is received. In one embodiment, the prong elements are movable with respect to one another in order to be able to selectively adjust the distance between the prong elements, and thus the size of the opening. As a result, the prong setting can accommodate jewelry stones of varying size.

Preferably, the prong elements of the setting are movable with respect to one another by being pivotally attached along the jewelry item. In particular, each prong element has a depending flexible pin element coupled to the jewelry item. Each pin element is received in a hole formed in the jewelry unit and can flex in both a forward and back direction. As a result, each prong element is adjustable in both a forward and back direction so that the setting is capable of receiving different size jewelry stones.

After the prong elements for any given jewelry item have been moved or positioned as directed, each prong element, including its corresponding depending pin element, is soldered and/or bonded in position.

In a preferred design, the prong elements include a top lip or wire portion used to engage the jewelry stone. The lip or wire portion of the design is specially sized and shaped to enhance the strength of the setting in holding the stone in position therewithin.

Accordingly, it is an object of the invention to provide an improved prong setting for a jewelry item.

Still another object of the invention is to provide a prong setting for a jewelry item which can accommodate various size jewelry stones.

Still a further object of the invention is to provide a prong setting for a jewelry item in which the bezel elements thereof may be adjusted in position therealong.

Yet another object of the invention is to provide a prong setting for a jewelry item in which a jewelry stone fits correctly therewithin.

A further object of the invention is to provide a setting for a jewelry item which has greater strength in retaining a stone.

Another object of the invention is to provide a setting for a jewelry item which enables better viewing of the retained stone.

Still other objects and advantages of the invention will in part be obvious and will in part be apparent from the following description.

The invention accordingly comprises the features, elements and parts as described in the following description, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 3 is a cross-sectional view taken along line 3—3 of FIG. 2;

FIG. 4 is a cross-sectional view taken along line 4—4 of FIG. 3;

FIG. 5 is a cross-sectional view taken along line 5—5 of FIG. 3;

FIG. 8 is an enlarged cross-sectional view showing a portion of the inventive bezel setting once soldering has taken place;

FIG. 9 is a side elevational view showing the inventive bezel setting retaining a jewelry stone and permanently fixed to the ring;

DETAILED DESCRIPTION OF THE PREFERRED EMBODIMENT

Figure 1:
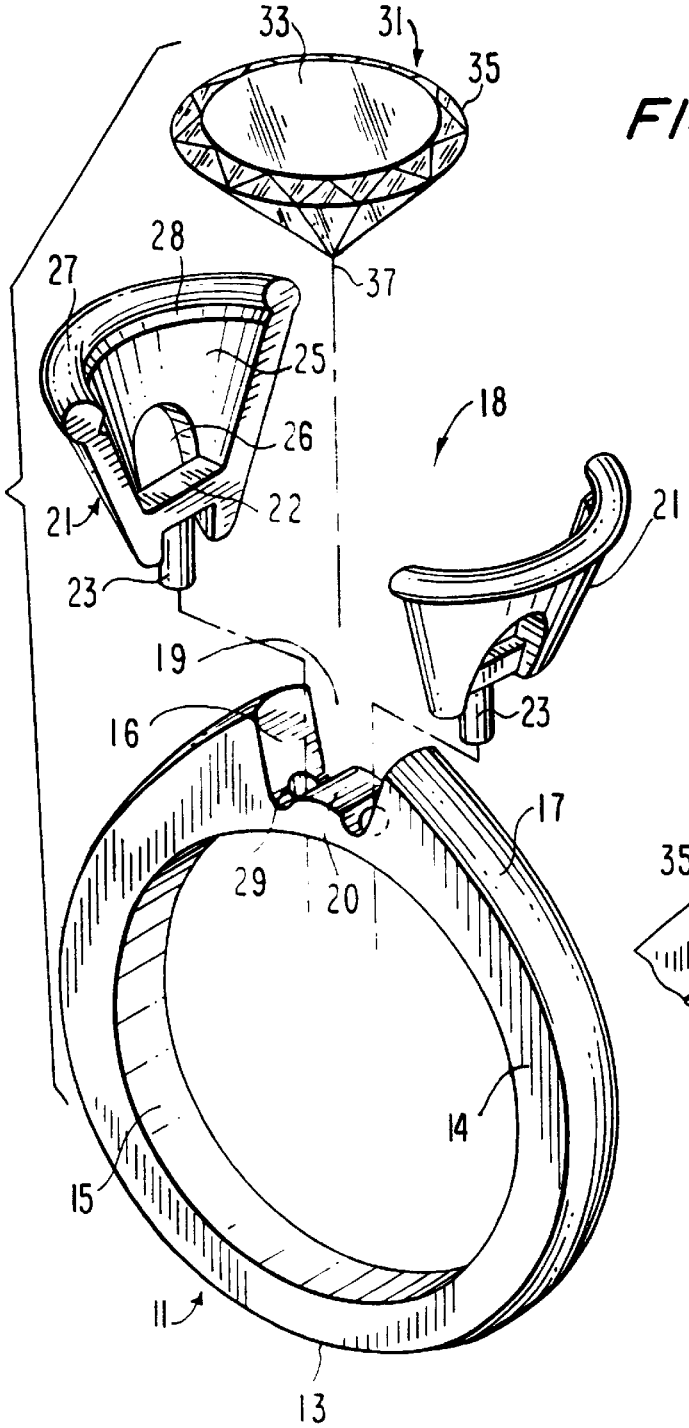
FIG. 1 is an exploded perspective view showing the various component parts of a ring assembly incorporating the inventive bezel setting.

Referring first to FIGS. 1–5, a ring assembly generally indicated at 11 and which utilizes the inventive setting 18 is described. Ring assembly 11 consists of a ring or shank 13 made from a precious metal such as gold, silver or platinum, defined by an outer surface 17, an inner surface 15 and a pair of sidewalls 14, as is well known in the art. Ring 13 is formed with a cut-out 19 in outer surface 17 in which setting 18 of the invention is received. Cut-out 19 formed in ring 13 is defined by a pair of sloped end walls 16 which lead to a separating protrusion 20, as shown in FIG. 1. Each of end walls 16 is formed with a radially inwardly extending hole 29 that is used for mounting bezel setting 18 within cut-out 19 of ring 13, as described below.

Figure 2:
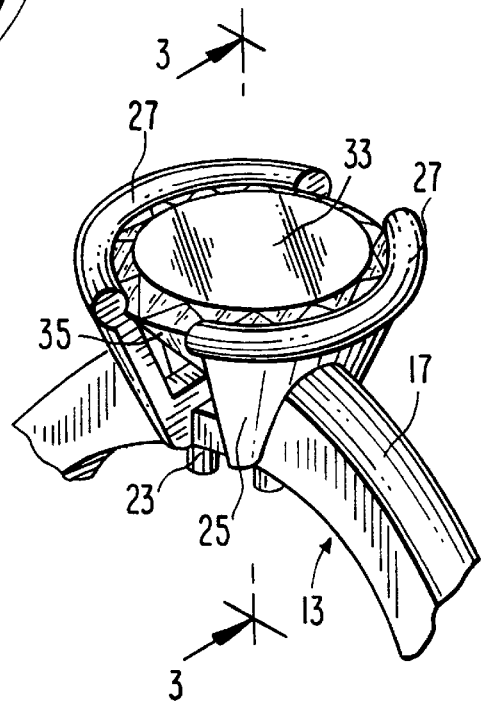
FIG. 2 is a perspective view of the inventive bezel setting mounted to a ring and retaining a jewelry stone therewithin.

Setting 18 is defined by two facing bezel elements 21 also made from a precious metal. Each bezel element 21 includes an inwardly curved member 25 (see FIG. 4) formed with a slot 26 that is sized to slidably pivot along outside surface 17 of ring 13. Curved member 25 increases in radial dimension in an upward direction and is formed with an annular running tubular lip 27. Lip 27 includes an underlying annular groove 28 in which the girdle of a stone mounted in bezel setting 18 is matingly received. Curved member 25 of each of bezel elements 21 leads to a lower axially running supporting bridge element 22 from which a depending pin 23 projects. Depending pin 23 of each of bezel elements 21 is designed for reception within holes 29 formed in cut-out 19 of ring 13, as best shown in FIGS. 2 and 3.

As is well known in the art, a jewelry stone, such as a round diamond, is generally indicated at 31 and includes a table portion 33, a girdle 35 below which is a tapered portion leading to a cutlet 37. Stone 31 is mounted within bezel elements 21 of bezel setting 18 (see FIGS. 2 and 3) such that girdle 35 is matingly received within grooves 28 of bezel elements 21, as discussed above, and cutlet 37 is disposed above bridge element 22.

Figure 7:
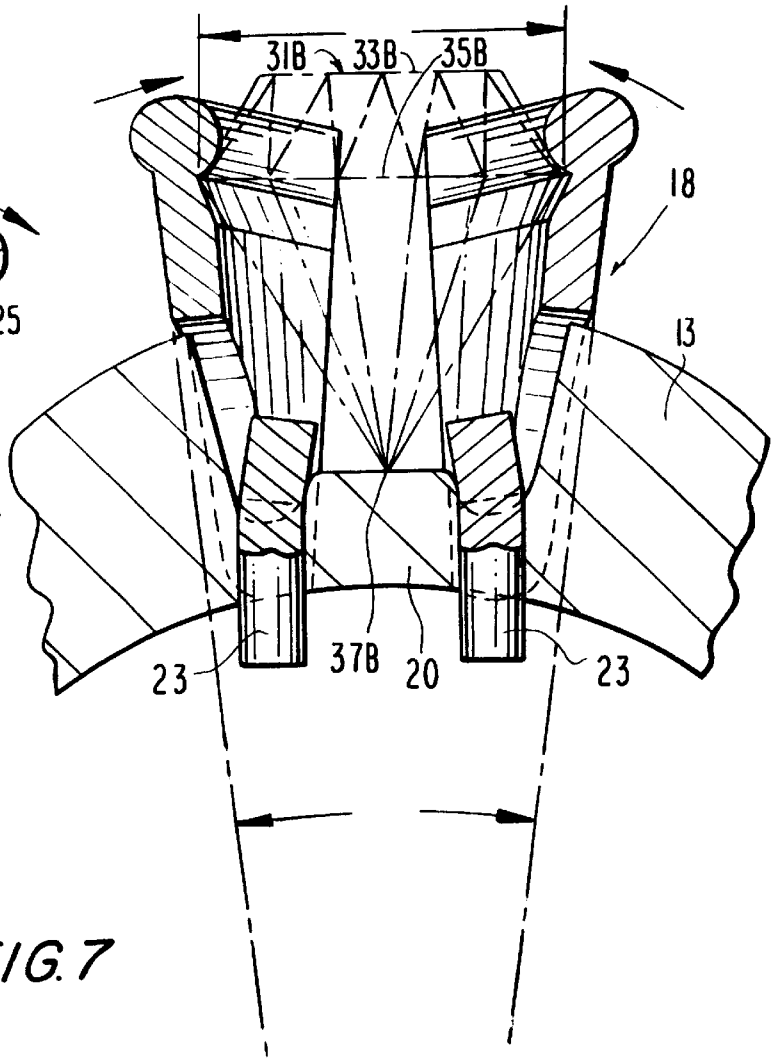
FIG. 7 is a side elevational view in partial cross-section showing the bezel elements of the inventive bezel setting being adjusted inwardly in order to accommodate a smaller size stone.
Figure 6:
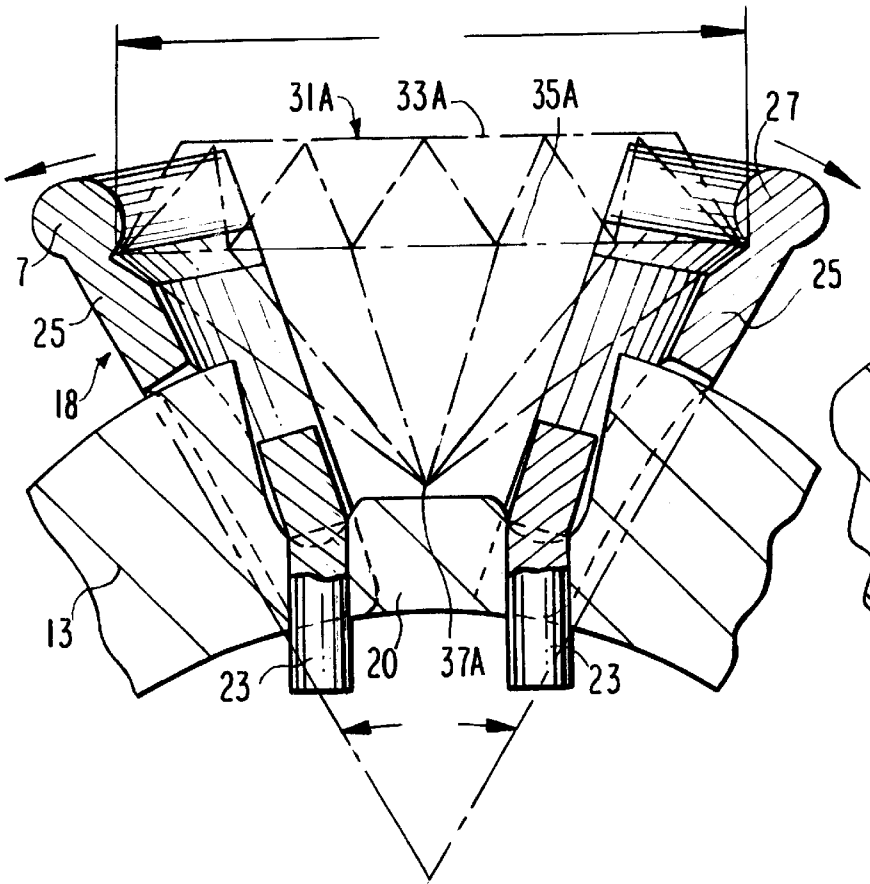
FIG. 6 is side elevational view in partial cross-section showing the bezel elements of the inventive bezel setting being outwardly adjusted in position in accommodate a larger size stone.

In order for setting 18 to accommodate varying size jewelry stones, pins 23, which are made from metal, of bezel elements 21 are selectively flexible in both forward and back directions (see FIGS. 6 and 7), such that each bezel element 21 is capable of slidably moving along ring 13 in corresponding forward and back directions. This is in part achievable since each bezel element 21 has a cut-out 26 which is shaped and sized to slidably fit over outside wall 17 of ring 13 at a location adjacent to where cut-out 19 is formed in ring 13. Accordingly, as shown in FIGS. 6 and 7, a larger size stone 33A, having a table portion 31A, girdle 35A and cutlet 37A, as well as a smaller size stone 31B, having a table portion 33B, a girdle 35B and a cutlet 37B, can be engagingly accommodated within inventive bezel setting 18.

As shown in FIGS. 8 and 9, once each of bezel elements 21 of setting 18 are slidably adjusted in position for accommodating a selected size jewelry stone, both curved member 25 and pin 23 are soldered or bonded in some other manner along end walls 16 of cut-out 19 formed in ring 13 by means of solder or bonding agent 38. A finished ring product, as shown in FIG. 9, is then achieved.

In accordance with the invention, each setting element is capable of being selectively moved back and forth to accommodate different size jewelry stones. Thus, a selected stone may be laid into the bezel setting in order to obtain a more desired fit than in conventional bezel settings. The advantage is that a buyer can see the jewelry stone in the setting as if it were set permanently therewithin, helping the buyer to envision what the jewelry item will look like when delivered to the buyer in permanent condition. In contrast, prior art bezel settings were not capable of having the stone fit correctly therein, and oftentimes the stone tends to float on top or go too low in the setting, which is less than desirable.

Figure 10:
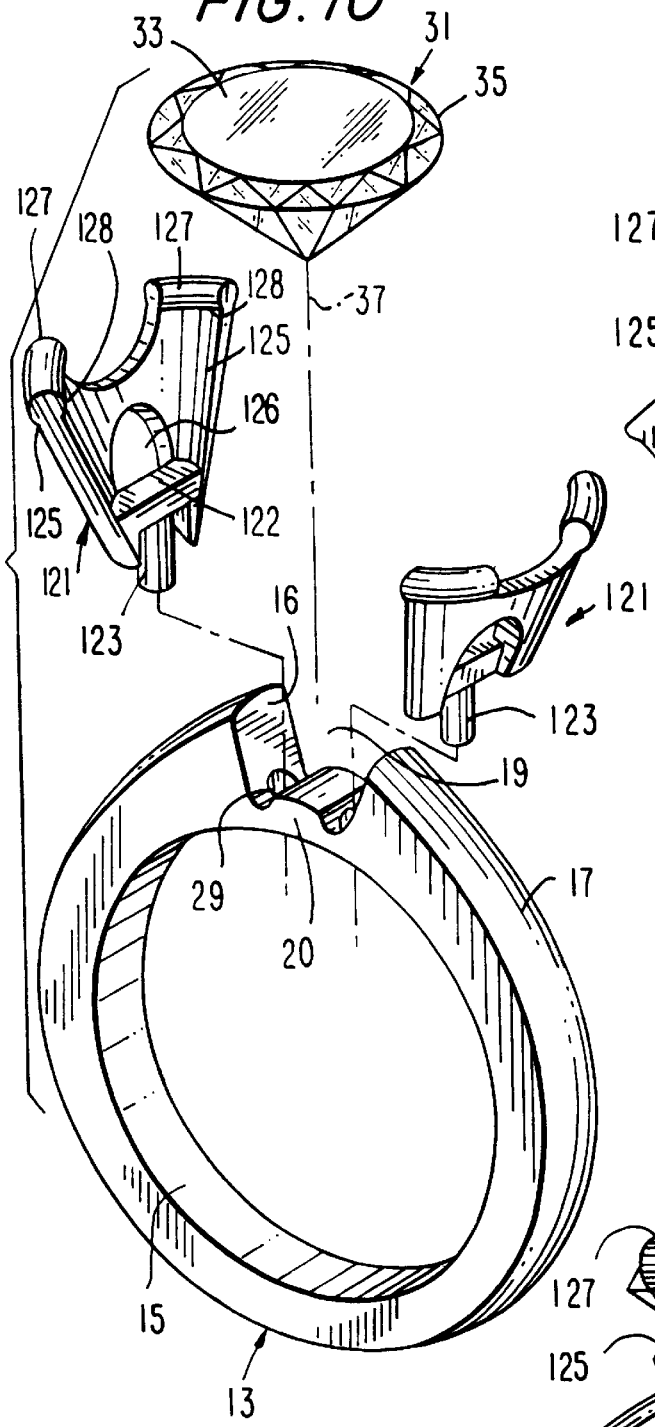
FIG. 10 is an exploded perspective view showing the component parts of a ring assembly incorporating the inventive prong setting.
Figure 11:
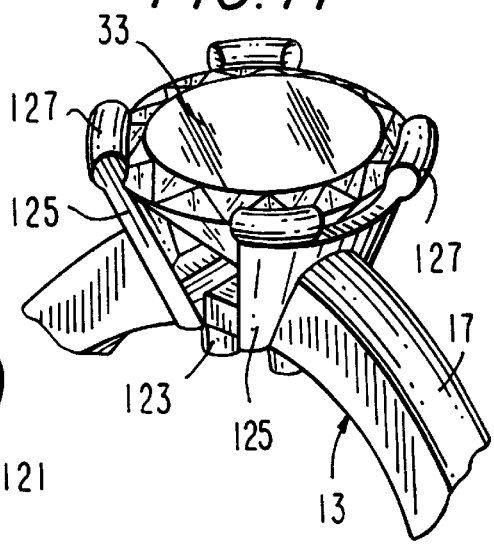
FIG. 11 is a perspective view of the inventive prong setting mounted to a ring and retaining a jewelry stone therewithin.
Figure 12:
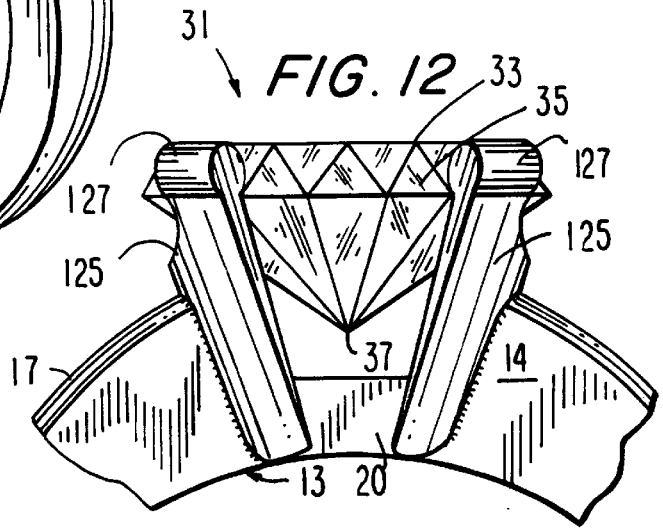
FIG. 12 is a cross-sectional view showing the inventive prong setting mounted to the ring.

Referring now to FIGS. 10–12, a prong setting is shown substituted for a bezel setting and is defined by two facing bezel elements 121 made from a precious metal. Each bezel element 121 includes a pair of upwardly depending prongs 125 separated by a slot 126 that is sized to slidably pivot along outside surface 17 of ring 13. Prongs 125 are each formed with a lip or wire portion 127 at the top end thereof. Lip or wire portion 127 of each prong 125 includes an underlying annular groove 128 in which girdle 35 of stone 31 mounted in the prong setting is matingly received. Prongs 125 of each of bezel elements 121 leads to a lower axially running supporting bridge element 122 from which a depending pin 123 projects. Depending pin 123 of each of bezel elements 121 is designed for reception within holes 29 formed in cut-out 19 of ring 13, as best shown in FIG. 11. As with the first embodiment of the invention, pins 123 of prong elements 121 are selectively flexible in both forward and back directions such that bezel elements 121 are capable of slidably moving along ring 13 in corresponding forward and back directions.

Figure 13:
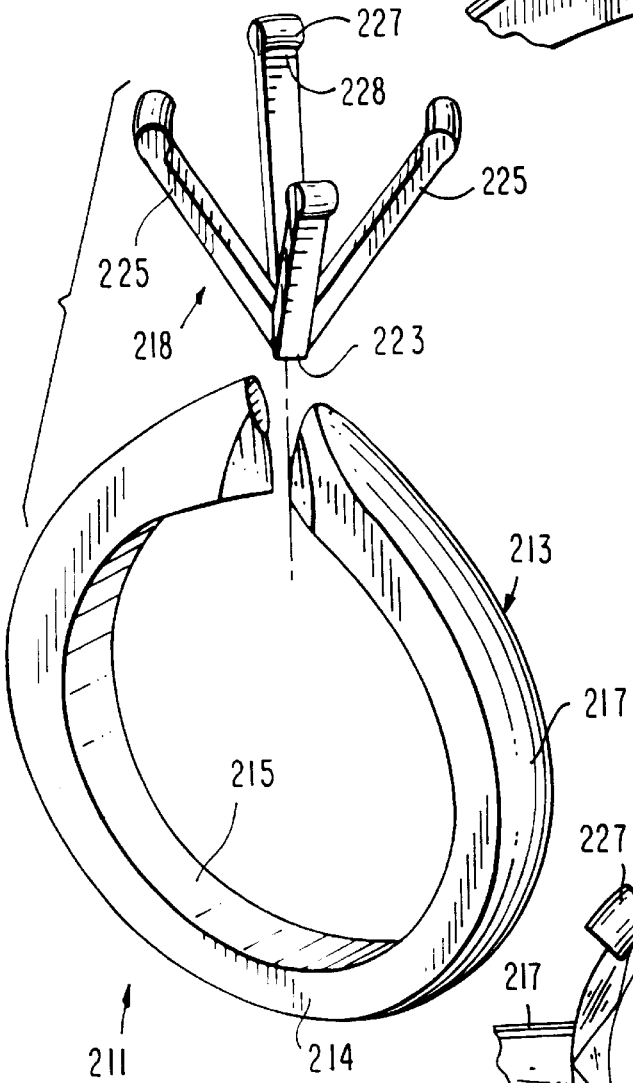
FIG. 13 is an exploded perspective view showing the component parts of a ring assembly incorporating an alternate embodiment of the inventive prong setting.
Figure 14:
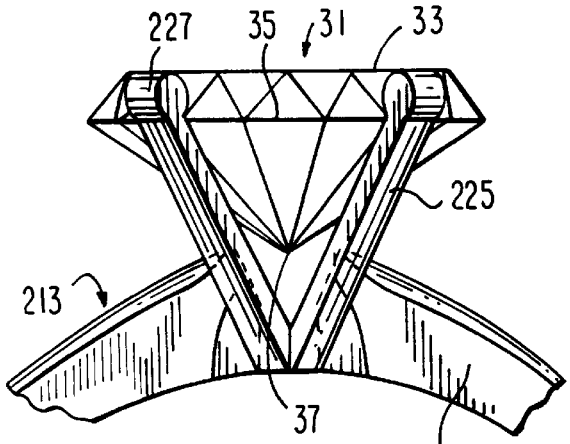
FIG. 14 is a side elevational view of the alternative embodiment of the inventive prong setting mounted to the ring.
Figure 15:
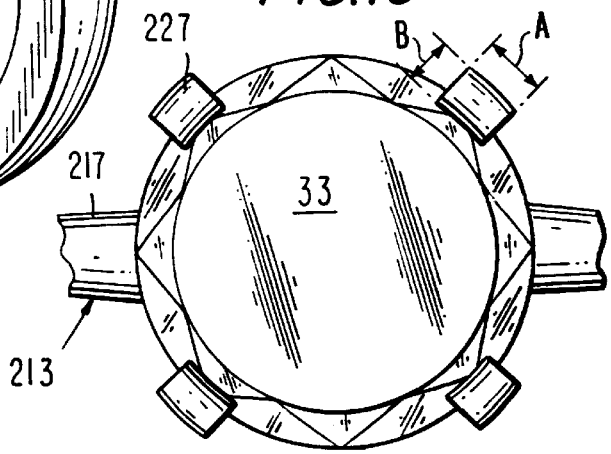
FIG. 15 is a top plan view of the alternative embodiment of the inventive prong setting mounted to the ring.

Referring now to FIGS. 13–15, an alternative embodiment of a ring assembly which utilizes the inventive prong setting is generally indicated at 211. Ring assembly 211 consists of a ring or shank 213 made from a precious metal such as gold, silver or platinum, and defined by an outer surface 217, an inner surface 215 and a pair of side walls 214, as is well known in the art. Ring 213 is formed with a cut-out portion 219 in which setting 218 of the invention is received.

Setting 218 includes a bottom 223 from which four upwardly depending, angularly directed and equally spaced prongs 225 extend. Each prong 225 is formed with a lip or wire portion 227 at the top end thereof. Lip or wire portion 227 of each prong 225 includes an underlying groove 228 in which girdle 35 of stone 31 mounted in prong setting 218 is matingly received. Each of lip or wire portions 227 has a substantially cylindrical configuration defining an arcuate length A (see FIG. 15) which extends from between about 18° and 27°. Significantly, the sum of the arcuate lengths of each of lip or wire portions 127 of prongs 225 is between about 20% and 30% of the circumference defined by girdle 35 of stone 31. This feature is found in both the embodiment of FIGS. 13 and 15, as well as the embodiment of FIGS. 10–12.

In the specific example shown in FIGS. 3–5, setting 218 consists of four prongs 225 having four corresponding lip or wire portions 227, as described above. Each wire portion 227, which is disposed at a substantially equal angular distances from the two adjacent wire portions 227, has an angular length A. The length A of each wire portion 227 is from between about 20% and 30% of one-quarter of the circumference defined by girdle 235—in other words, each wire portion 227 has an arcuate extent of 18° to 27°. This ensures sufficient contact between each of lip or wire portions 227 to girdle 35, maintaining a more secure engagement of stone 31 within setting 218. Preferably, each lip or wire portion 227 has an arcuate length of from between about 1½ and 2½ millimeters, with a width or thickness of B (see FIG. 14) of between about ¾ and 1¼ millimeters.

As can be appreciated from viewing the embodiment of FIGS. 13–15, as well as the embodiment previously discussed of FIGS. 10–12, lip or wire portion 227 of each of prongs 225 bulges outwardly in a direction away from stone 31. Significantly, lip or wire portion 227 bulges outwardly past the outside wall of each of prongs 225 in an amount between about 10% and 25% as compared to the width or thickness of each of prongs 225. This feature provides further reinforcement to the setting 218, enhancing its holding strength with respect to stone 31.

As can be appreciated from viewing FIGS. 11–12 and 14–15, the inventive prong setting design, while providing enhanced strength in holding a stone within the setting, still enables a substantial portion of the stone, whether viewed from the side, top or at an angle, to be visible. This is advantageous as compared to a bezel-type setting, as, by way of example, described in the embodiment of FIGS. 1–9.

It will thus be seen that the objects set forth above, among those made apparent from the preceding description, are efficiently attained, and since certain changes may be made in the invention described herein without departing from the spirit and scope of the invention, it is intended that all matter contained in the above description shall be interpreted as illustrative and not in a limiting sense.

It is also to be understood that the following claims are intended to cover all of the generic and specific features of the invention described herein, and all statements of the scope of the invention which, as a matter of language, might be said to fall therebetween.

What is claimed is:

1. A jewelry assembly comprising:

a jewelry element, a jewelry stone having a girdle, and a setting for retaining said jewelry stone and being mounted to said jewelry element;

wherein said setting comprises a plurality of jewelry prongs and having an inside and outside surface, each of said prongs having a top free end on which an arcuately extending wire portion engages a portion of said stone along said girdle;

wherein said stone has a circumference defined by said girdle;

wherein each said wire portion has an arcuate length such that the sum of said arcuate lengths of each of said wire portions of said plurality of prongs is from between about 20% and 30% of said stone circumference defined by said girdle.

2. The assembly of claim 1, wherein each of said wire portions of said prongs includes an underlying groove for selectively receiving said portion of said stone along said girdle.

3. The assembly of claim 1, wherein each said wire portion has a substantially cylindrical configuration.

4. The assembly of claim 1, wherein the arcuate length of said wire portion is from between about 1½ and 2½ millimeters.

5. The assembly of claim 1, wherein each said wire portion has a thickness from between about ¾ and 1¼ millimeters.

6. The assembly of claim 1, wherein said plurality of prongs comprises four prongs.

7. The assembly of claim 1, wherein at least one of said prongs depends from a bezel element.

8. A jewelry assembly comprising:

A jewelry element a jewelry stone having a girdle, and setting for selectively retaining said jewelry stone and being mounted to said jewelry element;

wherein said setting comprises a plurality of prongs, each having an inside and outside surface, and a top free end on which an arcuately extending wire portion engages a portion of said stone along said girdle;

wherein each of the wire portions has an arcuate extent of between about 18° and 27°.

9. The assembly of claim 8, wherein each of said wire portions of said prongs includes an underlying groove for selectively receiving said portion of said stone along said girdle.

10. The assembly of claim 8, wherein each said wire portion has a substantially cylindrical configuration.

11. The assembly of claim 8, wherein each of said wire portions has an arcuate length of from between about 1½ and 2½ millimeters.

12. The assembly of claim 8, wherein each said wire portion has a thickness from between about ¾ and 1¼ millimeters.

13. A jewelry assembly comprising:

a jewelry element, a jewelry stone having a girdle, and a setting for retaining said jewelry stone and being mounted to said jewelry element;

wherein said setting comprises a plurality of prongs each having a top free end comprising an arcuately extending wire portion which engages a portion of said stone along said girdle;

wherein each said prong defines a prong thickness;

wherein each said wire portion includes a bulge extending radially outwardly past said corresponding prong a distance of from between about 10% and 25% of said prong thickness.

14. The assembly of claim 13, wherein each of said wire portions of said prongs includes an underlying groove for selectively receiving said portion of said stone along said girdle.

15. The assembly of claim 13, wherein each said wire portion has a substantially cylindrical configuration.

16. The jewelry assembly of claim 13, wherein each of said wire portions has an arcuate length from between about 1½ and 2½ millimeters.

17. The assembly of claim 13, wherein each said wire portion has a thickness from between about ¾ and 1¼ millimeters.

18. The assembly of claim 13, wherein said plurality of prongs comprises four prongs.

19. The assembly of claim 13, wherein at least one of said prongs depends from a bezel element.

* * * * *